US006896158B2

(12) United States Patent
Leray et al.

(10) Patent No.: US 6,896,158 B2
(45) Date of Patent: May 24, 2005

(54) MULTIPLE-COMPARTMENT CONTAINER

(75) Inventors: Anne-Gaëlle Leray, Brussels (BE); Jean-Francois Patrick Etesse, Brussels (BE)

(73) Assignee: The Procter & Gamble Company, Cincinnati, OH (US)

( * ) Notice: Subject to any disclaimer, the term of this patent is extended or adjusted under 35 U.S.C. 154(b) by 8 days.

(21) Appl. No.: 10/669,112

(22) Filed: Sep. 23, 2003

(65) Prior Publication Data

US 2004/0069803 A1 Apr. 15, 2004

Related U.S. Application Data

(63) Continuation of application No. 09/850,465, filed on May 7, 2001, now abandoned.

(30) Foreign Application Priority Data

May 5, 2000 (EP) ..... 00870095

(51) Int. Cl.[7] ..... B67D 5/60
(52) U.S. Cl. ..... 222/145.1; 222/484; 222/518
(58) Field of Search ..... 222/145.1, 484, 222/518

(56) References Cited

U.S. PATENT DOCUMENTS

| | | | |
|---|---|---|---|
| 3,851,800 | A | 12/1974 | Swain |
| 4,585,150 | A | 4/1986 | Beachham et al. |
| 4,678,103 | A | 7/1987 | Dirksing |
| 4,958,749 | A | 9/1990 | Kuenzel et al. |
| 4,993,595 | A | 2/1991 | Bertram et al. |
| 5,692,626 | A | 12/1997 | Wehrle et al. |
| 5,765,725 | A | 6/1998 | Matt |
| 5,941,416 | A | 8/1999 | Balz et al. |
| 6,435,382 | B1 | 8/2002 | Giblin et al. |
| 6,470,910 | B2 | 10/2002 | Blackbourn et al. |

FOREIGN PATENT DOCUMENTS

| | | |
|---|---|---|
| EP | 0 479 451 B1 | 3/1996 |
| WO | WO 97/31095 | 8/1997 |

*Primary Examiner*—Philippe Derakshani
(74) *Attorney, Agent, or Firm*—Armina E. Matthews; Brahm J. Corstanje; Kim William Zerby

(57) ABSTRACT

The present invention relates to a multiple-compartment container for dispensing flowable products by gravity. The container described comprises a first compartment (51) and second compartment (52) for storing a first and a second composition. The container also comprises a multiple-dispensing tap (100), which preferably is operable by a pressing action and is capable of dispensing flowable products from the first and second compartments substantially simultaneously.

23 Claims, 7 Drawing Sheets

MULTIPLE-COMPARTMENT CONTAINER

CROSS REFERENCE TO RELATED APPLICATIONS

This is a continuation of U.S. application Ser. No. 09/850,465 filed May 7, 2001 now abandoned, which claims priority under 37 U.S.C. § 119(a) to European Application Serial No. 00870095.7, filed May 5, 2000.

TECHNICAL FIELD

The present application relates to the field of multiple-compartment containers. In particular this application relates to multiple-compartment containers suitable for dispensing flowable products by gravity, without pouring. The present application thus in one aspect describes multiple-compartment container comprising a multiple-dispensing tap.

BACKGROUND

Multiple-compartment containers are generally known in the art. Such containers may be used for many purposes, for example sequentially delivering two cooperating compositions or to deliver an aesthetic effect, and in other cases the container may be used to separate two reactive components of the composition. Dual compartment containers have been described in many forms and using a number of different dispensing mechanisms. EP 479 451 and WO97/31095 both describe multiple-compartment containers dispensed using a spray device, wherein a feed line from each compartment is linked to the spray nozzle and the compositions for each compartment are then dispensed using a manually or electrically operated pump system. U.S. Pat. No. 5,765,725 also describes a container, employing a different means of dispensing using a pump system. In this case the compositions are dispensed by squeezing the container. However, not every composition is suitable for spraying or even pumping especially where for example ingredients may be sensitive to the pressures of spraying or pumping, or the composition may be prone to undesirable foaming or alternatively the compositions may simply be too viscose to spray or pump. Moreover such spray or pump designed containers can be expensive to make and are not suitable for storing or dispensing large quantities of flowable product.

Compositions can also be dispensed using gravity in dual compartment pouring containers. Examples of such containers include those described in U.S. Pat. No. 4,678,103, U.S. Pat. No. 4,958,749 and U.S. Pat. No. 4,585,150. The containers described in these documents are pouring bottles. However such bottles present a number of problems that the Applicant has sought to solve. For example such bottles require the user to lift and tip at a specific angle in order to achieve the correct ratio of the first to the second compositions dispensed. Moreover the bottles described in these documents involve complicated designs of bottles inside bottles in order to achieve a constant dispensing ratio. Such complicated designs are difficult and expensive to make on a large scale.

Detergent compositions general require a number of active components, some of which can be chemically aggressive, whilst others are chemically sensitive. For this reason, especially when the compositions comprising such components are flowable products, it can be desirable to separate aggressive from sensitive components. Examples of aggressive components include especially oxidising agents, e.g. bleach, whilst sensitive ingredients may include oxidisable agents for example, enzymes, colouring agents and fragrances. Another problem identified when using the multiple-compartment packages available on the market is cross contamination of the compositions in the first and second compartments. Clearly cross contamination is a serious problem if the rational for using a dual compartment bottle is to keep specific ingredients separate. Nevertheless it has been found that containers designed according to U.S. Pat. No. 4,678,103 and U.S. Pat. No. 4,585,150 result in significant cross contamination during and especially at the end of pouring. Another problem is the safety of the container, for example where an aggressive ingredient is stored in the first compartment and more sensitive ingredients, in the second compartment. It has been found possible for the user to dispense from one compartment only, thus using a compositions which is potentially overly aggressive, which may result in damage to the surface to which the composition is applied e.g. fabrics or porcelain, and may even result in irritation of the skin of the user. Alternatively the user may dispense only the composition comprising the more sensitive components, resulting in the use of a composition which does not meet their requirements. Examples of containers where such is possible are described in U.S. Pat. No. 5,692,626 and WO94/16969.

In response to these problems of prior art multiple-compartment containers, the Applicants have developed a multiple-compartment container comprising a first and a second compartment, but optionally further compartments, that is capable of dispensing flowable products by gravity, preferably at a constant volume ratio and which also combats all of the above discussed problems.

SUMMARY OF THE INVENTION

According to the present invention there is provided a multiple-compartment container for dispensing flowable products by gravity comprising at least a first compartment 51, a second compartment 52 and a multiple-dispensing tap 100 comprising at least a first 101 and second 102 inlet, a hollow body defining a first 103 and second 104 outlet and a first 105 and second 106 channel wherein the first compartment is linked to the first inlet and the second compartment is linked to the second inlet of the dispensing tap.

The present invention also relates to a dual compartment container for dispensing two or more flowable products by gravity at constant volume ratio, comprising a first compartment 51 and a second compartment 52 each comprising a flowable product wherein equations relating the height of the compartment, cross-sectional area of fluid in the compartment, dispensing orifice size and geometry and flow properties of the flowable product are used to define the geometry of the compartments of the container to achieve a constant ratio dispensing flow rate. Hence in a further aspect of the present invention there is also provided a dual compartment container for dispensing two or more flowable products by gravity at constant volume ratio, comprising a first compartment 51 and a second compartment 52 each comprising a flowable product A and B respectively, the compartments being designed to satisfy the equation $Q_A=\alpha Q_B$ for each dispensed dose. For a given dispensing orifice geometry, preferably circular tube or tap geometry and product properties, the flow rate equations are expressed as follows:

$$Q_A = \frac{\pi R_A^3}{4\mu_A}\left[\frac{\rho_A g R_A(H_A)}{2L_A}\right] \text{ and } Q_B = \frac{\pi R_B^3}{4\mu_B}\left[\frac{\rho_B g R_B(H_B)}{2L_B} - \frac{4\tau_{oB}}{3}\right]$$

Where product A is a Newtonian fluid and product B a Bingham fluid and wherein:

Q is the volume flow rate of products A and B respectively $\alpha$ is the volume ratio R is the radius of each tap channel L is the length of each tap channel H is the liquid head of A and B respectively in each compartment g is gravity $\tau$ is yield stress $\mu$ is the viscosity In yet a further aspect of the present invention there is provided a multiple-dispensing tap 100 suitable for attachment to a container, comprising at least a first 101 and second 102 inlet, a hollow body defining at least a first 103 and second 104 outlet, a valve system for controlling flowable product through the outlet and a means for operating the valve system characterised in that the hollow body comprises at least two channels 105, 106 capable of substantially simultaneously dispensing two different flowable products.

DETAILED DESCRIPTION OF THE INVENTION

The invention will now be described by way of example and with reference to the accompanying diagrams in which.

Figure 1:
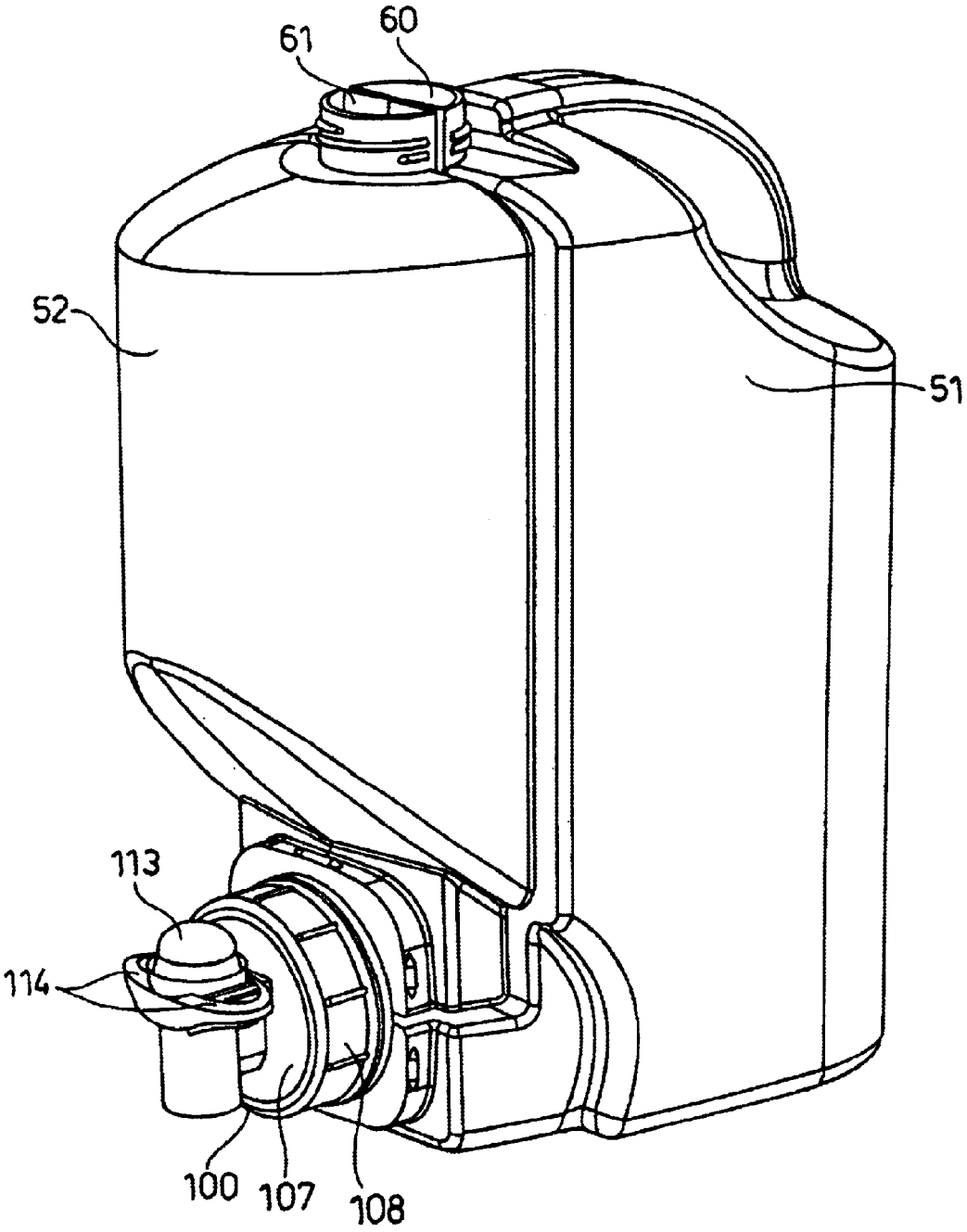
FIG. 1 is perspective view of the multiple compartment container
Figure 2:
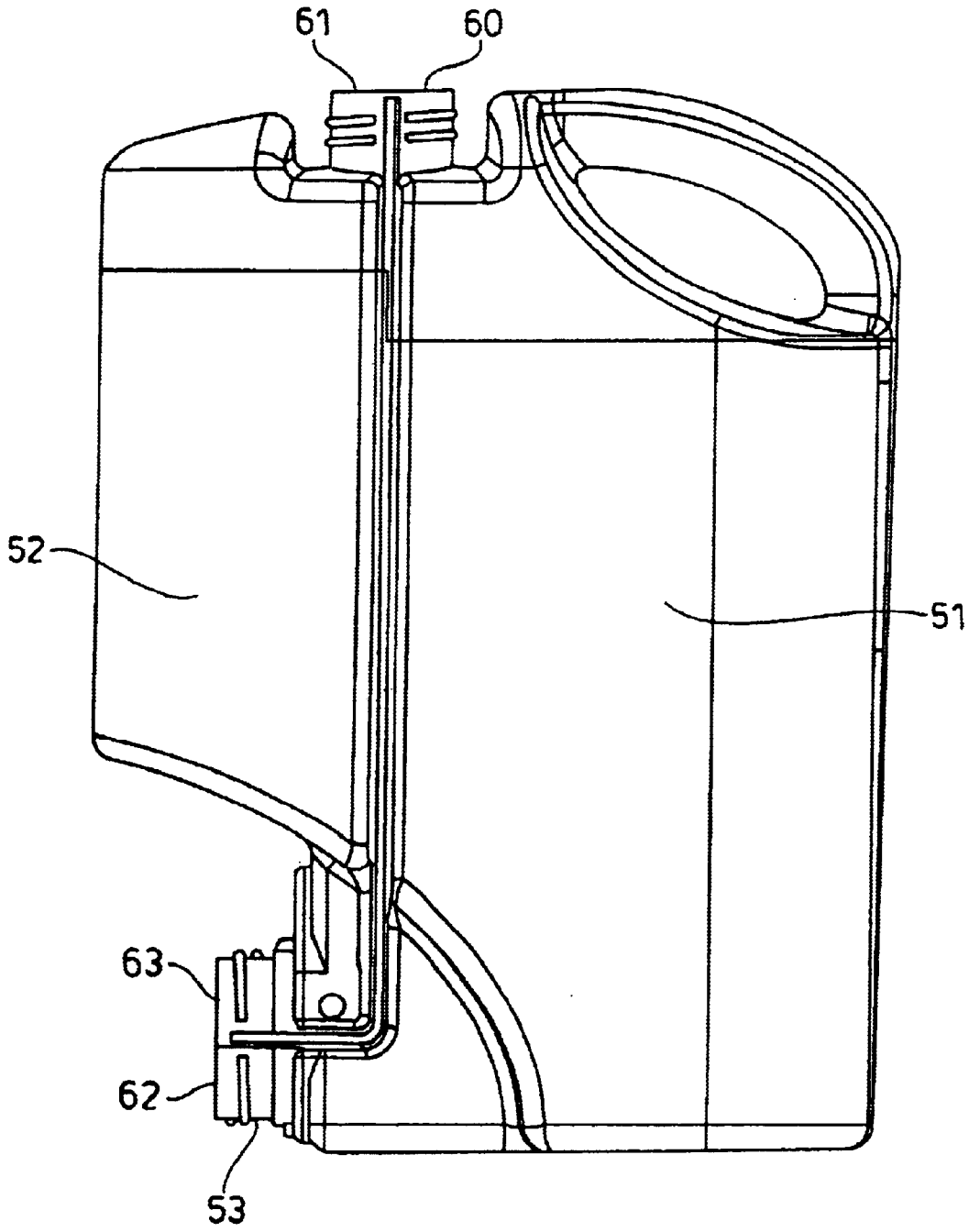
FIG. 2 is a side view of the multiple compartments
Figure 3:
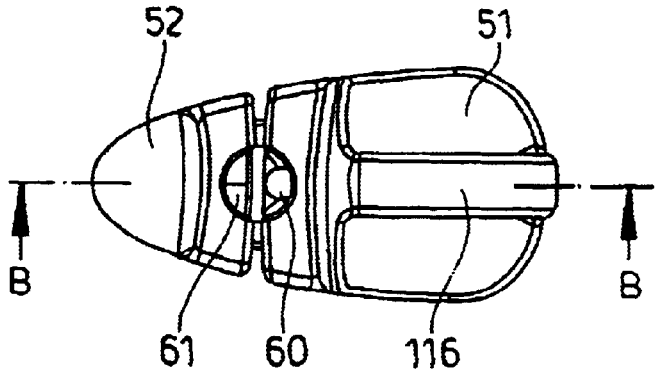
FIG. 3 is a plan view if the multiple compartments
Figure 4:
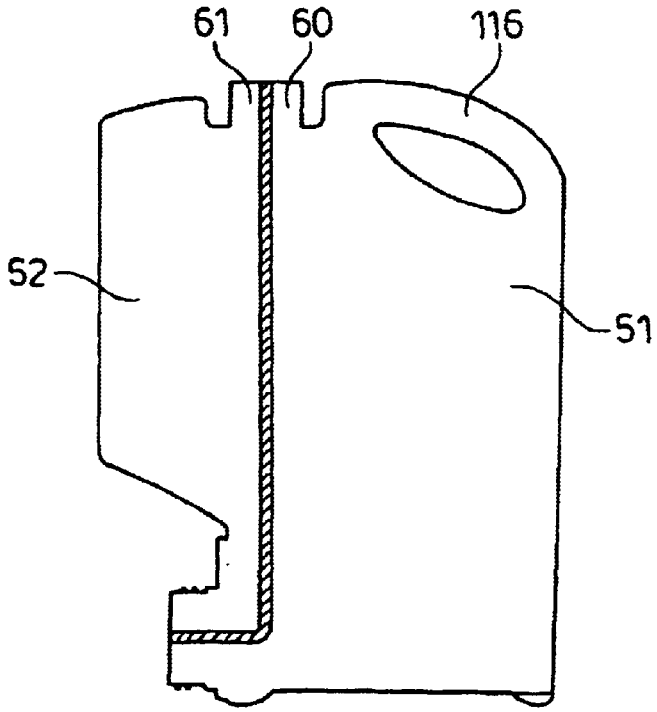
FIG. 4 is a cross-sectional view through B—B of FIG. 3
Figure 5:
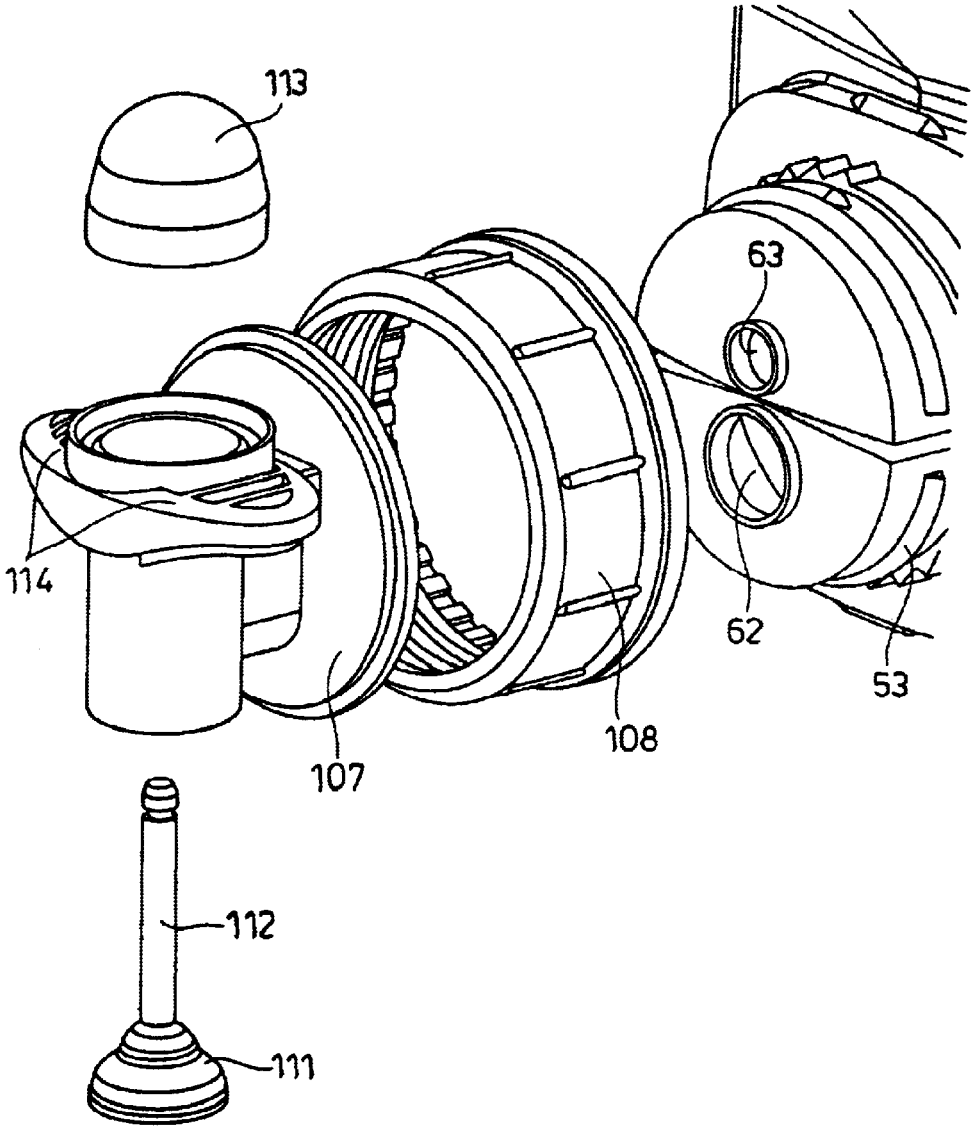
FIG. 5 is a exploded perspective view of the multiple-dispensing tap
Figure 6:
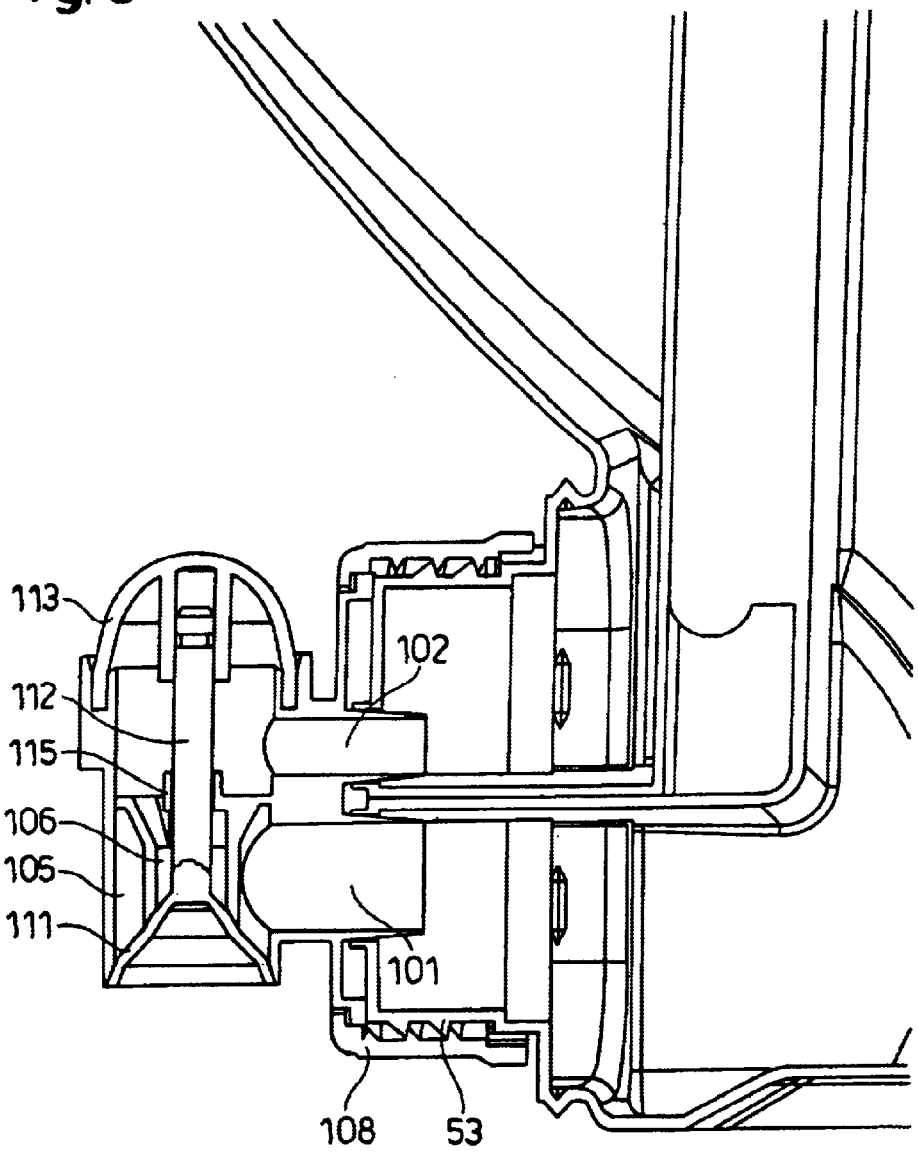
FIG. 6 is a cross-sectional view of the multiple-dispensing tap
Figure 7:
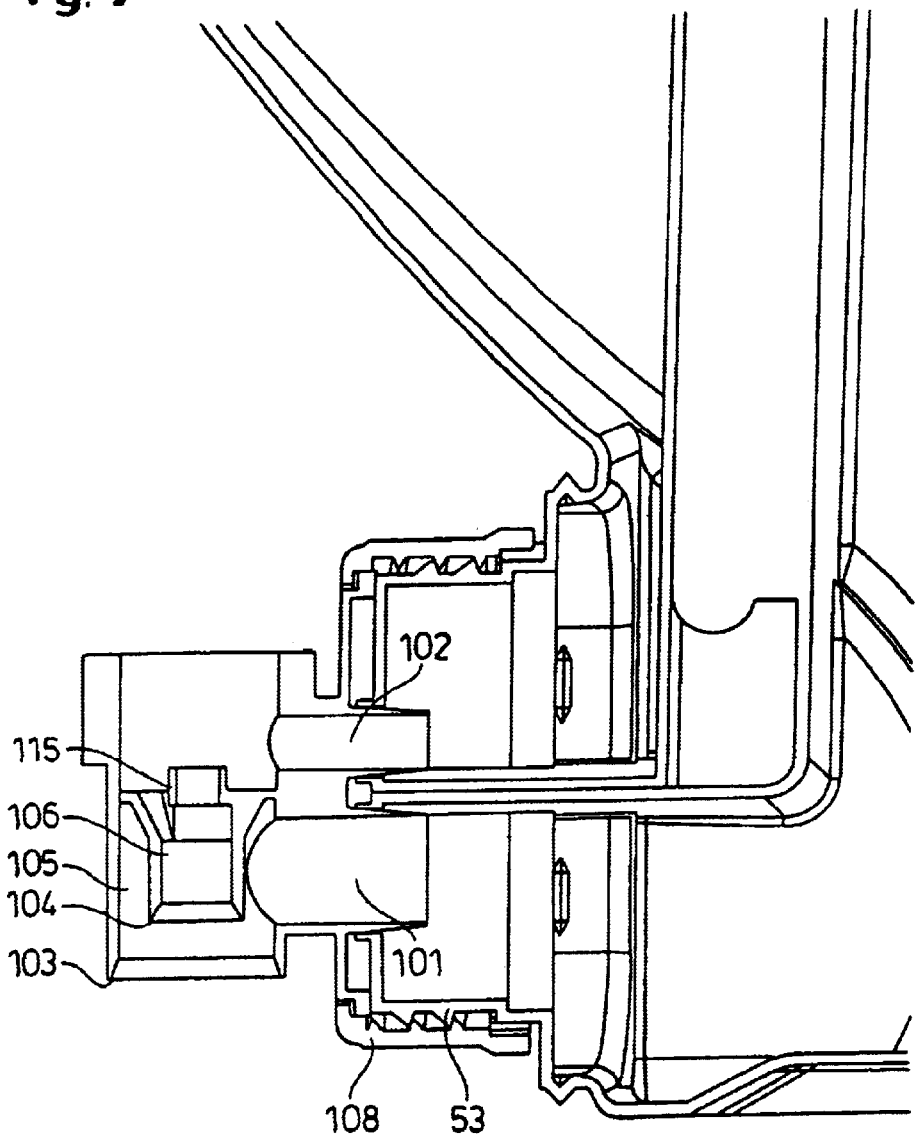
Figure 8:
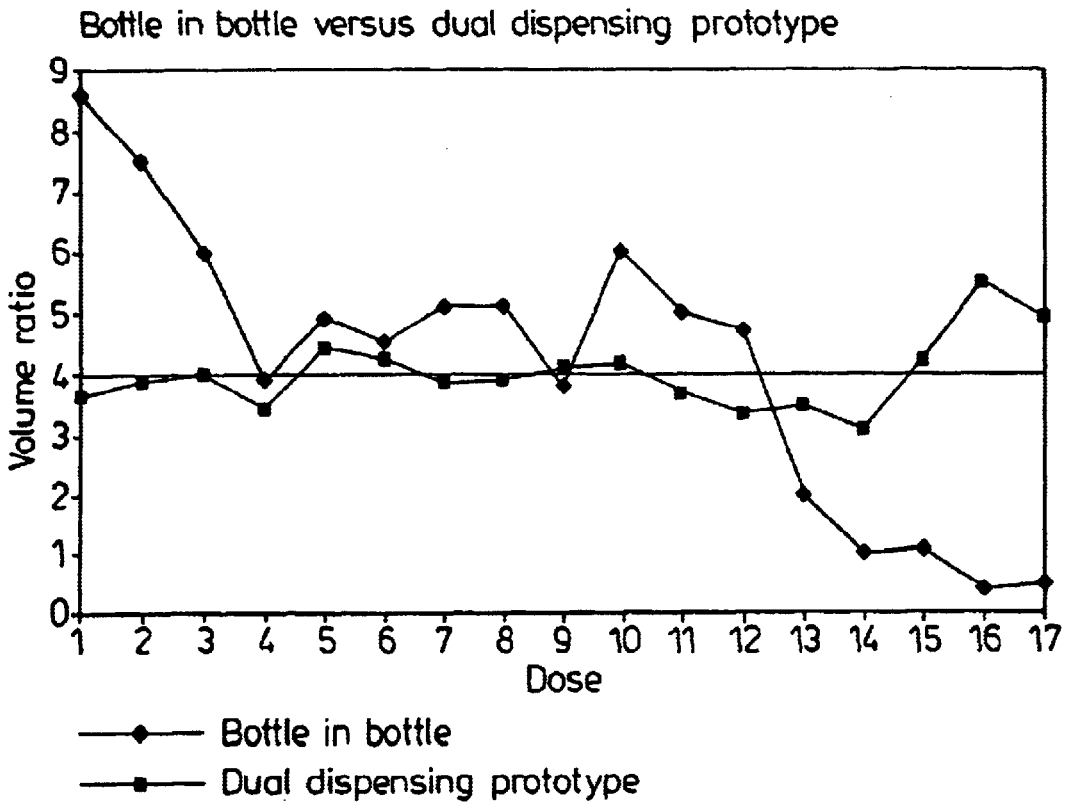

FIG. 7 is a cross sectional view of the multiple-dispensing tap with the valve system removed FIG. 8 is a graphical representation of the ratio of a dispensed product A to product B FIG. 1 illustrated a perspective view, FIG. 2 illustrates a side view and FIG. 3 a plan view of the preferred embodiment of the present multiple-compartment container. The container of the present invention comprises at least two compartments 51,52 and a multiple-dispensing tap 100. However it is also envisaged that the present container may comprise more than two compartments, preferably three or even four compartments. Said container can be either substantially rigid, flexible or collapsible. Said container can be made from plastic, glass, metal or metal alloy or a combination thereof. More preferably the container, including all elements of the container, are made from plastic, more preferably thermoplastic material. Examples of preferred thermoplastic materials include polypropylene (PP), polyethylene (PE), polyethylene terephthalate (PET) or a combination thereof.

In a first preferred embodiment, the container is substantially rigid, and comprises top, bottom and peripheral side walls. The bottom wall of the container preferably comprises a "push-up" where the surface of the container in contact with the flowable product is raised, for example is inclined or bowed in order to reduce the volume flowable product trapped below the height of the dispensing orifice. Furthermore a "push-up" also aids the stability of the container. Each compartment is preferably provided with a venting hole 60, 61. The venting holes provide at least two functions, namely it allows the escape of gas developed by the flowable product during storage and allows the equalization of the pressure in the compartment once flowable product has been dispensed through the orifice. In a preferred embodiment the vent hole is covered. In a preferred aspect the cover takes the form of a cap which can be sealed. As used herein the term sealed means the prevention of flow of the product. However especially in the instance of venting holes, the fact that the venting hole is sealed does not impede the escape of gas. In a preferred embodiment the cap is fitted with a venting liner or membrane which facilitates the escape of gas when the cap is in the sealed position.

The first 51 and second 52 compartments each comprise a dispensing orifice 62, 63, which are preferably located in close proximity to each other and to the cooperating channel of the dispensing tap. The dispensing tap may be attached to the compartments using any suitable means. In a preferred embodiment, the container is equipped with a neck portion 53 which extends from the multiple-compartments and provides a location of attachment of the multiple-dispensing tap to the compartments. The neck portion can be located at any position on any wall of the container, but must be in a position such that dispensing of the product from the container can be achieved. The neck portion is preferably located in a position on the peripheral walls, more preferably near the base of the peripheral wall. The neck can have any suitable shape, but is preferably substantially cylindrical and comprises at least two dispensing opening, one from each compartment. In one embodiment, the neck portion comprises at least one screw thread, onto which at least one corresponding screw thread of the dispensing tap can be attached, optionally releasably, but preferably unreleasably. In another embodiment, the dispensing tap may be attached to the neck by means of a groove or protrusion on the neck to which at least one corresponding protrusion or groove of the dispensing tap is clipped in a non-releasable manner. Where present the neck portion can be made from any of the materials as listed above, however the neck portion is preferably rigid.

The multiple-dispensing tap 100, which is suitable for attachment to a multiple-compartment container and allows dispensing of at least two flowable product, preferably without allowing cross-contamination. The dispensing tap thus comprises at least a first 101 and a second 102 inlet, a hollow body defining at least a first 103 and a second 104 outlet, a valve system and a means for operating the valve system. The inlets are designed to cooperate with the dispensing openings of the compartments. The shape and size of the inlets is dependent on the desired flow rate of the product in the compartment. The hollow body comprises at least two channels 105, 106 through which the product stored in the compartments is conveyed from the container to the tap outlet. In one embodiment the channels in the tap direct the product to a mixing chamber, where the products are intentionally mixed prior to dispensing from the container. However, in a preferred embodiment the channels are designed such that no cross-contamination occurs, but the products can mix at the outlets.

In a further preferred embodiment the dispensing tap and the means for attachment of the tap to the compartments of the container are separate. The elements of the tap, e.g.

inlets, outlets, valve system, hollow body, are mounted on a plate 107 which fits flush against the neck or wall of the compartments. The plate is then fixed to the neck or wall using a collar 108 which comprises a means for attachment to the neck or wall of the container. The attachment means is preferably a screw thread system which corresponds with the screw on the neck or wall of the compartments. In a further preferred embodiment the inlets of the dispensing tap are plug sealed, meaning that the inlets comprise a short length of tubing such that when attached the tubing forms a seal with the dispensing orifices of the compartments. In yet a further preferred aspect of this embodiment the dispensing orifices of the compartments are sealed with a membrane and then covered using a cap, for example a screw cap that cooperates with the screw system designed for attachment of the dispensing tap. Then when the container is to be used the cap is removed and the membrane pierced using the protruding short length of tubing of the inlets of the tap. In this way it is possible to provide the consumer with a recharge unit comprising product, allowing the consumer to reuse the dispensing tap. However it is also envisaged that additional product may also be provided by way of a refill pack from which new product is poured to refill the container.

Whilst the present invention is mainly focused on providing a container for dispensing at least two compositions at constant ratio, it is also envisaged that a container may be provided from which two compositions may be dispensed at different ratios by fitting a dial plate. The dial plate may be fitted in between the dispensing tap and the compartments. It is essentially similar to the plate described above with the difference that it is fitted in addition to the plate described above and can be rotated 360°. The dial plate comprises two holes which are capable of cooperating with the dispensing orifices of the compartments and the inlets of the dispensing tap. When the dial plate is in a position such that the holes in the dial plate are 100% aligned with the inlets of the tap and orifices of the compartments then product can flow unobstructed. The dial plate can then be rotated such that it obstructs a portion or all of the tap inlets hence reducing or even preventing flow of product through the inlet and changing the ratio of one composition to the other. Alternatively the dial plate may be located at any point where the flow of product can be successfully and efficiently obstructed, for example in the channels of the dispensing tap or in the compartments, especially in the area of the dispensing orifices.

The valve system provides a means of controlling the flow of product from the compartments, though the dispensing tap to the outlet and environment. The valve system comprises any valve system known to those skilled in the art and suitable for the purpose. In an especially preferred embodiment of the present invention the valve system comprises a valve element 111 and a valve stem 112. The valve element is a device capable of sealing each outlet. In a preferred embodiment the valve element seals both outlets simultaneously. In order to seal the outlet the valve element must thus have a cooperating shape. Preferably the valve element has a frustoconical shape. The valve element may further comprise an additional seal, by which it is meant a band or strip of sealing material which is applied to the edge of the valve element or outlet to improve the connection between the valve element and the outlet. The valve stem connects the valve element and the means for operating the valve system. The valve stem is preferably located, and capable of moving, within a guide means 115.

In a particularly preferred embodiment the first 105 and second 106 channels are concentric such that the second channel is located inside the first channel. In a further preferred embodiment the valve stem is also located within the second channel such that the second product flows in between the valve stem and the wall defining the second channel.

The valve system may be operated in any suitable way, but is preferably rotationally, more preferably pressure operated. The preferred valve system is pressure operated such that the pressure forces the displacement of the valve stem which in turn pushes the valve element to the open position, opening the tap. When pressure is removed from the operating means, the valve stem moves back to it's original position and the valve element, back to the closed position from where it started. Pressure is preferably applied to a push button comprising a deformable diaphragm 113 which deforms when pressure is applied with the result of operating the valve system and reforms its original shape when pressure is removed. In order to assist the user in applying pressure to the deformable diaphragm the dispensing tap is equipped with wings 114 on either side of the tap to provide an area where the user can apply counter force. In an alternative embodiment of the present invention the tap comprises a barrier, which is located such that flowable product is prevented from coming into contact with the push button.

The tap may also be provided with extended channels i.e. a spout, which can be arranged to as to provide the most effective trajectory of flowable product for collection by the user.

In embodiments as described above wherein the container comprises more than two compartments, the dispensing tap preferably comprises as many inlets, channels and outlets as there are compartments. However it is also envisaged in these embodiments that the dispensing tap may comprise fewer channels and outlets in order to allow some or all of the products from the compartments to mix before dispensing from the container.

The container optionally comprises at least one gripping means 116. The gripping means may be for example a handle. The handle may be integral to or and an extension of the multiple-compartments. Alternatively the gripping means may comprise an area of the surface of the container which is modified to facilitate grip by the user. An example of this second embodiment, may be for example the texturing of the container surface to increase friction.

In a second embodiment, the container body is flexible and may be for example a bottle. Such an embodiment, may require a second more rigid container to provide additional mechanical support. In a third embodiment, the container body comprises a collapsible pouch, sachet or bag which is inserted into a second and more rigid container. In this case, the rigidity of the outer wall provides mechanical resistance, whereas the inside collapsible wall avoids the need for a venting system while the container contents is dispensed. Such an arrangement is commonly known as a bag-in-box container.

The process used for making a container as described above depends on the size, shape and materials of the container being made. In the case where the container is rigid, suitable manufacturing processes may be appropriately chosen by a skilled person. Such processes may include, but are not limited to: injection molding, injection-blow-molding, or extrusion-blow-molding. In the case where the container is flexible and/ore malleable, suitable manufacturing processes can again be selected by the skilled person. However such processes include, but are not limited to: extrusion-blow-molding, injection-molding. In the latter case, a bag, sachet or pouch may also be produced by a forming and sealing process, with the rigid neck being sealed or integrated on one side of the bag, sachet or pouch. In a preferred embodiment the container is made by molding two separate compartments, by any suitable means, which are then irreversibly joined to each other, using any suitable means, for example, adhesive, lock and key system of cooperating surfaces etc. In an alternative preferred embodiment the first and second compartments are made by irreversibly pinching along the length of a single compartment container, thereby providing two separate compartments.

The containers as described above are designed to store flowable products. The flowable products stored in the first and second compartments may be the same, but are preferably different. By different it is meant that the flowable product compositions differ in that at least one component of the first composition stored in the first compartment, is not present in the second composition stored in the second composition, or vice versa. The flowable products may be in particulate, gel or paste form, but is preferably a liquid. In one embodiment of the present invention the flowable products stored in the first and second compartments have different rheological properties, for example the flowable products may have different viscosities, densities, flow properties etc.

In another preferred embodiment the first composition is a conventional non bleach-containing detergent and the second composition comprises a bleaching agent. The bleaching agent maybe any known bleaching agent, but is preferably a pre-formed peracid. In a particularly preferred embodiment the bleach-containing second composition is a suspension of a phthaloyl peroxycarboxylic acid.

The flowable products are very preferably dispensed from the container at a constant ratio to one another. More preferably the compositions are dispensed at a ratio of the flowable product in the first compartment (first composition) to the flowable product in the second compartment (second composition) of 1:1 to 10:1, even more preferably 3:1 to 5:1.

In a particularly preferred embodiment the compartments of the container, are designed such that the user can dispense a constant ratio of product from the first compartment and the second compartment throughout use. In order to dispense the compositions at constant ratio it is necessary that the relationship between the flow rate of each composition also remains constant over time. If the compositions have the same flow properties then the compartments can in fact be identical, as long as it is intended to dispense a 1:1 ratio of each product in each dose. However, in the case where the desired ratio is not 1:1 or the flow properties of the compositions are not identical, then new compartment dimensions are required. The Applicants have found that a solution to achieving this constant relationship, even when the flow properties of the compositions are different, can be to design the compartments of the container baring in mind some key principles. These key principles are dispensing orifice geometry, fluid head of the composition and cross sectional area of the composition. Hence if you assume a constant dispensing period, in order to increase the volume of flowable product dispensed per dispensing period in one compartment, the container manufacturer can for example increase the orifice size of the compartment, creating a larger space for the escape of fluid; increase the head of flowable product in the compartment, hence creating a larger pressure on the composition; and/or increase the cross sectional area of the composition in the compartment. The compartments are thus designed to satisfy the following equation:

$$Q_A=\alpha\cdot Q_B \quad (1)$$

Where $Q_A$ is the flow rate of the product A contained in the compartment A, going through the channel A $Q_B$ is the flow rate of the product B contained in the compartment B, going through the channel B $$\alpha=\frac{V_A}{V_B}$$

is so called the volume ratio, $V_A$ is the volume of product A in each dispensed dose and $V_B$ is the volume of product B in each dispensed dose.

The flow rate of each product through the tap channel can be expressed as a function of the difference of pressure between the channel inlet and outlet ($\Delta P$), fluid properties and tap channel geometry by solving the appropriate "equation of State" and "equation of change". The form of these equations is dependent on the product properties and on the channel geometry.

$$Q_A=f(\Delta P_A,\text{ fluid properties } A,\text{ channel geometry } A)\text{ and } Q_B=f(\Delta P_B,\text{ fluid properties } B,\text{ channel geometry } B)$$

(1 bis)

In the present case, the pressure difference can be expressed as a function of the flowable product column above the channel inlet. The outlet pressure is equal to the atmospheric pressure.

$$\Delta P=P_{inlet}-P_{outlet}=(\rho\cdot g\cdot H+P_{atm})-P_{atm}=\rho\cdot g\cdot H$$

Then, the flow rate of each product can be written as a function of the head of this flowable product, fluid properties and tap channel geometry:

$$Q_A=f(H_A,\text{ fluid properties } A,\text{ channel geometry } A)\text{ and } Q_B=f(H_B,\text{ fluid properties } B,\text{ channel geometry } B) \quad (2)$$

By combining equations (1) and (2):

$$f(H_A)=\alpha\cdot f(H_B)$$

By rearrangement the terms of this equation, it can be written as:

$$H_A=f(H_B,\ A\text{ and }B\text{ fluid properties},\ A\text{ and }B\text{ channel geometry}) \quad (3)$$

This is the first key equation for the compartment design. It allows us to evaluate what the head of flowable product has to be for each product in order to maintain the equation (1) true for each dispensed dose.

By definition, a volume of liquid can be defined as the multiplication of the liquid cross section (area) and the liquid head:

$$\text{Volume}=\text{crosssection}\cdot\text{head}\Leftrightarrow V=S\cdot h$$

For a dispensed dose, we will observe a variation of product A liquid head ($\Delta H_A$) and a variation of product B liquid head ($\Delta H_B$). Each variation corresponds to a dispensed volume, $V_A$ and $V_B$ Then:

$$V_A=S_A\cdot\Delta H_A\text{ and }V_B=S_B\cdot\Delta H_B \quad (4)$$

Where:

$S_A$ and $S_B$ are respectively the cross section of the compartment with product A and the compartment with product B.

By definition, the volume ratio α is equal to:

$$\alpha = \frac{V_A}{V_B} \tag{5}$$

From equation (4) and (5):

$$S_A \cdot \Delta H_A = \alpha \cdot S_B \cdot \Delta H_B \tag{6}$$

For a dose n, equation (3) is written as:

$$H_A^n = f^1(H_B^n) \tag{7}$$

For the next dose n+1, equation (3) is written as:

$$H_A^{n+1} = f^1(H_B^{n+1}) \tag{8}$$

By making the difference between equation (7) and (8), the variation of product A liquid head can be expressed as a function of variation of product B:

$$\Delta H_A = f^2(\Delta H_B) \tag{9}$$

It is then possible to establish the cross section relationship between product A compartment and product B compartment (equation (6) and (9)). This relationship completes the description of the package as it links both fluid properties, both channel geometries and the cross section of each compartment.

$$S_A = f^3(S_B, A \text{ and } B \text{ fluid properties}, A \text{ and } B \text{ tap channel geometry}) \tag{10}$$

Thus, for two given products A and B and a given tap, for any liquid head of product A in its compartment (for any volume), we can define the liquid head of product B in its compartment by equation (3) and we can establish the value of their respective cross section by equation (10) in order to have $Q_A = \alpha \cdot Q_B$ verified for each dispensed dose.

The above equations will now be further described by reference to an example: Product A is a Newtonian fluid and product B is a Bingham fluid.

Each product is dispensed via a different circular channel (radius $R_A$, $R_B$ and length $L_A$, $L_B$) in the tap. The previous equations can be used as there is no interaction between the two products. The variables used in these equations are:

| Product A | Product B |
|---|---|
| Total volume: $V_A$ | Total Volume: $V_B$ |
| Viscosity: $\mu_A$ | Viscosity: $\mu_B$ |
| Density: $\rho_A$ | Density: $\rho_B$ |
| Head: $H_A$ | Yield stress: $\tau_{oB}$ |
| Flow rate: $Q_A$, $Q_{Amax}$ | Head: $H_B$ |
| | Flow rate: $Q_B$, $Q_{Bmax}$ |

For product A: For Product B:

$$Q_A = \frac{\pi R_A^3}{4\mu_A}\left[\frac{\rho_A g R_A (H_A)}{2L_A}\right] (1bis\text{-}E)$$

$$Q_B = \frac{\pi R_B^3}{4\mu_B}\left[\frac{\rho_B g R_B (H_B)}{2L_B} - \frac{4\tau_{oB}}{3}\right] (1bis\text{-}E)$$

Tap Channels Geometry

It is assumed that the tap channels have a circular geometry. The length of each tube has to be fixed and it is the same for the two product channel. The radius of each product channel is expressed as a function $$f(R) = \frac{\pi R^4 \rho g H_{\max}}{8L\mu} - \frac{\tau_o \cdot \pi R^3}{3\mu} - Q_{\max} \tag{a}$$

To solve this equation, the method of bisection is used. Hmax (maximum fluid head) and Qmax (maximum flow rate) are fixed based on consumer requirements. The value of R for f(R)=0 is calculated.

If the fluid is Newtonian, the evaluation of R and L is simplified:

$$\frac{R^4}{L} = \frac{8\mu \cdot Q_{\max}}{\pi \rho g H_{\max}} \tag{b}$$

Ratio Control

The aim of the tap is to dispense two products in a given ratio α. The dispensed dose will have:

$$\text{Total Volume} = V_A + V_B \text{ and } V_A = \alpha \cdot V_B$$

To dispense these two products in the required ratio, $Q_A$ has to be α times $Q_B$ for each dispensed dose.

For a given product and tap channel geometry, the flow rate depends on the liquid head above the tap inlet (equation 2).

To keep $Q_A = \alpha \cdot Q_B$ true for each dose the liquid heads of product A and product B are linked by the following equation for each dose n:

$$H_A^n = \frac{L_A}{L_B}\frac{\mu_A^n}{\mu_B^n}\frac{R_B^4}{R_A^4}\frac{\rho_B}{\rho_A}\alpha(H_B^n) - \frac{8}{3}\frac{L_A}{R_A \rho_A g}\left(\frac{R_B^3}{R_A^3}\frac{\mu_A^n}{\mu_B^n} \cdot \alpha\tau_{oB}\right) \tag{3-E}$$

For any generalised newtonian fluid (GNF) model, a similar relationship can be established in order to determine the fluid head of each product in the compartment. In this example, at a given product fluid head, the relationship of the cross sections for each liquid for a given dose n is given as a function of the tap geometry and product properties:

$$\frac{S_B^n}{S_A^n} = \frac{L_A}{L_B}\frac{R_B^4}{R_A^4} \cdot \frac{\mu_A^n}{\mu_B^n}\frac{\rho_B}{\rho_A} \tag{10-E}$$

If $\mu$ is not constant the cross section relationship will not be constant.

Numerical Example:

Objective was to calculate the dimensions of a package to deliver a constant volume ratio (Product A/Product B) of 4. Product properties and press tap dimensions were fixed:

| Product (A) | Product (B) |
|---|---|
| Total Volume: $V_A$ = 2400 ml | Total Volume: $V_B$ = 600 ml |
| Viscosity: $\mu_A$ = 200 cps | Viscosity: $\mu_B$ = 170 cps |
| Density: $\rho_A$ = 1.08 | Density: $\rho_B$ = 1.08 |
| | Yield stress: $\tau_{oB}$ = 1 Pa (average) |

Equation (3-E) was used to establish the required variation of liquid head of product A respective to product B liquid head in the first and second compartments in order to achieve 4:1 ratio control. Equation (10-E) was further used to establish the cross section relationship between both compartment.

A stereolithography prototype of the resulting dual compartment container was built using the dimensions derived from the equations above. The container was then used to sequentially dispense doses of approximately 200 ml of total product each. The table below provides a comparison of the reduction in head of liquid in each compartment after each dose, calculated using the equations above and as seen in experiment using the prototype container. The table also shows that the prototype container succeeded in dispensing product A and B at a ratio of 4:1 over time. An exception to this 4:1 ratio can be seen in the last three doses where as can be seen from the equation-derived data, the compartments no longer exhibit the cross section area relationship.

| Equation-derived data | | | | | | Experimental data | | | |
|---|---|---|---|---|---|---|---|---|---|
| Dose | A height (mm) | B height (mm) | A cross section ($cm^2$) | B cross section ($cm^2$) | cross section ratio ($S_B/S_A$) | Dose | A height (mm) | B height (mm) | Dose Volume Ratio |
| 1 | 176.00 | 169.90 | 136.82 | 46.68 | 0.34 | 1 | 176.50 | 170.00 | 3.65 |
| 2 | 164.30 | 161.30 | 136.82 | 46.68 | 0.34 | 2 | 164.80 | 160.60 | 3.88 |
| 3 | 152.60 | 152.70 | 136.82 | 46.68 | 0.34 | 3 | 153.80 | 152.30 | 3.98 |
| 4 | 140.90 | 144.00 | 136.82 | 46.68 | 0.34 | 4 | 143.20 | 144.50 | 3.45 |
| 5 | 129.20 | 135.40 | 136.82 | 46.68 | 0.34 | 5 | 133.20 | 136.00 | 4.42 |
| 6 | 117.50 | 126.70 | 136.82 | 46.68 | 0.34 | 6 | 122.50 | 128.90 | 4.24 |
| 7 | 105.90 | 118.10 | 136.82 | 46.68 | 0.34 | 7 | 111.80 | 121.50 | 3.86 |
| 8 | 94.20 | 109.50 | 136.82 | 46.68 | 0.34 | 8 | 101.80 | 113.90 | 3.91 |
| 9 | 82.50 | 100.80 | 136.82 | 46.10 | 0.34 | 9 | 91.40 | 106.10 | 4.10 |
| 10 | 70.80 | 92.20 | 136.82 | 44.71 | 0.33 | 10 | 81.20 | 98.80 | 4.15 |
| 11 | 59.10 | 82.96 | 136.75 | 43.29 | 0.32 | 11 | 71.00 | 91.60 | 3.71 |
| 12 | 47.30 | 72.96 | 135.59 | 40.00 | 0.30 | 12 | 60.50 | 83.20 | 3.37 |
| 13 | 35.40 | 61.21 | 134.45 | 34.05 | 0.25 | 13 | 50.70 | 74.00 | 3.49 |
| 14 | 25.00 | 45.35 | 153.84 | 25.21 | 0.16 | 14 | 40.50 | 64.10 | 3.11 |
| 15 | 15.00 | 16.32 | 160.00 | 13.78 | 0.09 | 15 | 30.50 | 51.40 | 4.23 |
| | | | | | | 16 | 21.00 | 38.20 | 8.40 |
| | | | | | | 17 | 10.50 | 23.60 | 4.93 |

In order to provide an additional comparison, FIG. 8 provides a graphical representation of the ratio of a dispensed product A to product B, dosed sequential from two different dual-compartment containers, namely the container according to the present application (dual dispensing prototype) and a container according to the bottle-in-bottle design described in U.S. Pat. No. 4,678,103. As can be seen from FIG. 8, the bottle-in-bottle design fails to consistently dose the products at a 4:1 ratio, whereas the container according to the present invention is considerably more successful.

What is claimed is:

1. A container for dispensing flowable products by gravity comprising a first compartment, a second compartment and a dispensing tap comprising a first and second inlet, a hollow body defining a first and second outlet and a first and second channel wherein the first compartment is linked to the first inlet and the second compartment is linked to the second inlet of the dispensing tap, said tap further comprising a valve system for controlling flowable product through the outlet and means for operating the valve system.

2. A container according to claim 1 made from plastic.

3. A container according to claim 1 wherein the tap is pressure operated.

4. A container according to claim 1 wherein the container comprises a gripping means.

5. A container according to claim 4 wherein the gripping means is a handle or a surface of the container designed to facilitate gripping.

6. A container according to claim 1 wherein the first and second compartments comprise different flowable products which are preferably allowed to mix at the outlets.

7. A container according to claim 1 wherein the flowable products are dispensed from the first and second compartments substantially simultaneously.

8. A container according to claim 1 wherein the flowable products are dispensed from each compartment at a constant volume ratio.

9. A container according to claim 1 wherein the ratio of dispensing of the flowable product in the first compartment to the dispensing of the flowable product in the second compartment is 1:1 to 10:1.

10. A container according to claim 9 wherein the ratio is from 3:1 to 5:1.

11. A container according to claim 1 wherein the flowable product in the first compartment is a conventional non bleach-containing detergent and the flowable product in the second compartment comprises a bleach.

12. A dual compartment container for dispensing two or more flowable products by gravity at constant volume ratio, comprising a first compartment and a second compartment each comprising a flowable product A and B respectively, the compartments being designed to satisfy the equation $$Q_A = \alpha Q_B$$

where, $$Q_A = \frac{\pi R_A^3}{4\mu_A}\left[\frac{\rho_A g R_A(H_A)}{2L_A}\right] \text{ and } Q_B = \frac{\pi R_B^3}{4\mu_B}\left[\frac{\rho_B g R_B(H_B)}{2L_B} - \frac{4\tau_{oB}}{3}\right]$$

Product A is a Newtonian fluid and product B a Bingham fluid and wherein:

Q is the flow rate of products A and B respectively;

$\alpha$ is the volume ratio;

R is the radius of each tap channel;

L is the length of each tap channel;

H is the liquid head of A and B respectively in each compartment;

g is gravity;

$\tau$ is yield stress; and, $\mu$ is the viscosity.

13. A dual compartment container according to claim 12 wherein $\alpha$ is from 1 to 10.

14. A dual compartment container according to claim 12 wherein $\alpha$ is 4.

15. A multiple-dispensing tap suitable for attachment to a container comprising a first and second inlet, a hollow body defining a first and second outlet, a valve system for controlling flowable product through the outlet, a means for operating the valve system, and the hollow body comprises at least two channels capable of substantially simultaneously dispensing two different flowable products.

16. A dual dispensing tap according to claim 15 wherein the valve system is pressure or rotationally operated.

17. A multiple-dispensing tap according to claim 15 that is a pressure operated tap.

18. A multiple-dispensing tap according to claim 15 wherein the valve system comprises a valve element and valve stem which connects the valve element to the means of operating the valve system.

19. A multiple-dispensing tap according to claim 15 wherein the means for operating the valve system is a push button made from a deformable diaphragm.

20. A multiple-dispensing tap according to claim 19 wherein the deformable diaphragm is bleach stable.

21. A multiple-dispensing tap according to claim 18 wherein the valve element is frustoconical.

22. A multiple-dispensing tap according to claim 18 wherein the valve element or outlet additionally comprises a seal.

23. A multiple-dispensing tap according to claim 18 wherein the valve stem is capable of movement in a guide means mounted in the body.

* * * * *